US005289901A

United States Patent [19]

Fargo

[11] Patent Number: 5,289,901

[45] Date of Patent: Mar. 1, 1994

[54] HYDRAULIC ELEVATOR PRESSURE RELIEF VALVE

[75] Inventor: Richard N. Fargo, Plainville, Conn.

[73] Assignee: Otis Elevator Company, Farmington, Conn.

[21] Appl. No.: 926,630

[22] Filed: Aug. 3, 1992

[51] Int. Cl.[5] ..... B66B 11/04

[52] U.S. Cl. ..... 187/17; 187/29.2; 91/454

[58] Field of Search ..... 187/17, 29.2, 38, 110; 91/452, 454, 446, 448

[56] References Cited

U.S. PATENT DOCUMENTS 3,842,943 10/1974 Nakamura et al. ..... 187/17

4,676,140 6/1987 Haussler ..... 187/17

5,082,091 1/1992 Fargo ..... 187/17

*Primary Examiner*—D. Glenn Dayoan

*Assistant Examiner*—Kenneth Noland

[57] ABSTRACT

A hydraulic elevator pressure relief valve is activated if a pilot valve disposed therein senses an excessive pressure build up within a hydraulic elevator system. The pilot valve opens once excess fluid pressure force is detected. A main piston then facilitates communication between a solenoid valve disposed within the valving system and the drain pressure thereby closing a check valve and thus stopping an elevator car from further movement. The main piston further ports the excess fluid pressure force from the system to drain pressure, thus stabilizing the fluid pressure force therein.

6 Claims, 2 Drawing Sheets

HYDRAULIC ELEVATOR PRESSURE RELIEF VALVE

TECHNICAL FIELD

This invention relates to a hydraulic elevator and, more particularly, to a relief valve used with the hydraulic elevator valving control system.

BACKGROUND ART

Hydraulic elevators are comprised of a cab, a plunger attached to the cab either directly or by means of a roping configuration, and a cylinder housing the plunger. Hydraulic fluid is impelled into the cylinder to drive the plunger and the cab attached thereto, upwardly. The fluid is typically impelled into the cylinder by means of a constant speed motor which drives the fixed displacement pump.

This type of hydraulic elevator requires valves to control the cab speed during acceleration, leveling, and lowering of the elevator. The valves waste energy while controlling the motion of the elevator by discharging excess fluid flow. Valves may also be noisy and provide relatively poor control.

Some hydraulic elevators utilize a variable speed pump and motor. In this type of elevator, hydraulic fluid is impelled into and out of the cylinder to drive the plunger and the cab attached thereto upwardly and downwardly. The variable speed pump and motor are known to reduce the control problem and greatly simplify the number of valves. However, a valve is still required to maintain the elevator at a landing. One such type of a valve is disclosed in U.S. patent application 07/701,369, wherein the valve controls the pressure between the pump and the elevator, thereby controlling the movement of the elevator car.

In case of excessive pressure build up, most hydraulic elevator systems require some means of limiting pressure within the system to preserve the integrity thereof. Therefore, most systems provide some type of a switch or a relief valve that in case of excessive pressure increase within the system, limits such pressure build up. However, safety problems arise when the excess pressure is limited.

DISCLOSURE OF THE INVENTION

It is an object of the invention to provide a hydraulic elevator driven by a variable speed pump, motor, a control valve, and a relief valve which allows the elevator to operate safely.

It is a further object of the invention to stop the elevator car descent or elevation if pressure in the system exceeds a preset limit.

It is a further object of the invention to provide a relief valve that senses an increase in pump fluid pressure exceeding a preset limit, upon which the relief valve ports the pump fluid to drain pressure.

According to the invention, a relief valve is activated when a pump fluid pressure force exceeds a preset fluid pressure prescribed within the relief valve, thereby closing a check valve and preventing an elevator car from further movement. The relief valve also facilitates reduction of fluid pressure within the system to preserve the integrity thereof.

The relief valve is disposed in a fluid circuit connecting a variable speed pump and the check valve. As the relief valve senses that the fluid pressure from the pump exceeds the preset fluid pressure limit prescribed within the relief valve, the relief valve opens and allows the hydraulic fluid to be ported from a line leading to the check valve to drain pressure, thereby closing the check valve. The relief valve further allows the hydraulic fluid to be ported from the pump to drain pressure, thereby reducing the pressure of the system. When the check valve is closed, the elevator car is prevented from further movement, thus ensuring the safety of its passengers. As the pump fluid pressure force is reduced, the pressure within the system is stabilized, thus preventing damage thereto.

According to a feature of the invention, a surface area of a pilot valve disposed within the relief valve upon which the fluid pressure force acts is enlarged to provide an increase in the speed of porting of the fluid and thus to facilitate halting of the elevator car, while allowing the relief valve to operate at a pressure lower than the preset fluid pressure.

These and other objects, features and advantages of the present invention will become more apparent in light of the following detailed description of a best mode embodiment thereof as illustrated in the accompanying drawing.

BEST MODE FOR CARRYING OUT THE INVENTION

Figure 1:
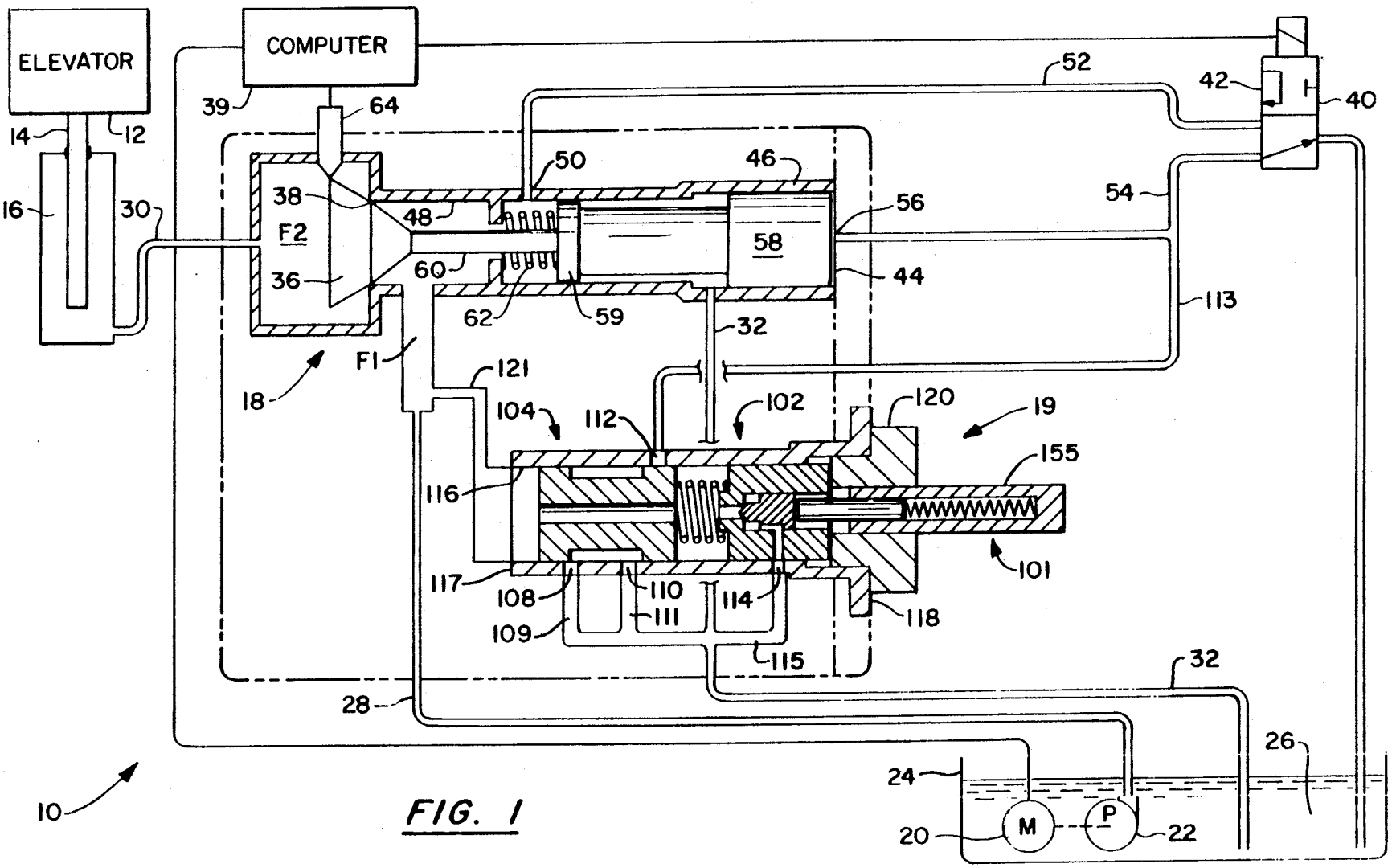
FIG. 1 is a schematic diagram, partly in section, of an embodiment of a relief valve used with a variable speed motor, pump, and a check valve in a hydraulic elevator.

The elevator system 10 is comprised of an elevator car 12, a plunger 14, a hydraulic cylinder 16, a check valve 18, a relief valve 19, and a conventional variable speed reversible motor 20 and pump 22. The pump and motor are disposed within a tank 24 which is filled with hydraulic fluid 26. As is known in the art, the motor powers the pump to provide a variable fluid pressure force (FPF) to raise and lower the elevator.

A first FPF F1 of the pump is communicated between the valve 18 and the pump 22 via line 28. A second FPF F2 is communicated between the valve 18 and the hydraulic cylinder 16 via line 30. A drain pressure line 32 is provided between the check valve 18 and the tank 24.

When the cab 12 is at rest at a landing (not shown) a frustoconical portion 36 of the check valve 18 is seated against a circumference 38 to prevent hydraulic fluid from flowing through the valve 18 from the cylinder 16 to the tank 24 via lines 30 and 28, thereby maintaining the cab at the landing.

If it is desired to move the cab 12 to a lower landing, a computer 39 energizes a solenoid valve 40 to activate the first circuit 42, thereby allowing the first FPF Fl to be communicated to an open end 44 of a cylinder 46 through a central bore 48, first solenoid port 50, line 52, line 54, second solenoid port 56, and to a piston head 58 in the cylinder 46. The piston head 58 is urged by the first FPF against a spring seat 59 which is connected to the frustoconical portion 38 via a rod 60. The computer 39 also activates the motor 20 to increase the first FPF.

The frustoconical portion 36 remains seated against the circumference 38 until the sum of the first FPF on the frustoconical portion 36 and the piston head 58 overcomes the second FPF F2 and the spring force of a spring 62. When the sum of the first FPF exceeds the sum of the second FPF and the spring force of the spring, the frustoconical portion 36 is unseated from the circumference 38, thereby opening the check valve 18. Essentially the check valve is open when the first FPF is approximately equal to the second FPF.

Once the valve 18 is opened, a position sensor 64 alerts the computer 39 that the variable speed motor 22 may then be controlled to follow a chosen speed profile to lower the cab 12 to the next landing. Such a profile may allow the motor to gradually slow to control the downward rate of acceleration, go into reverse (thereby generating energy) and then reverse again to slow the cab as it approaches the desired landing.

The relief valve 19 comprises a housing 100 which contains an adjuster 101 and two stages: a first stage 102 and a second stage 104. The housing 100 has a substantially cylindrical shape having a first opening 108 disposed around the circumference thereof that communicates with the tank 24 via lines 109 and 32. A second opening 110 that communicates with the tank 24 via lines 111 and 32. A third opening 112 that communicates with the solenoid 40 via lines 113 and 54 and a fourth opening 114 that communicates with the tank 24 via lines 115 and 32. The housing further has a central bore 116, one open end 117, and a second open end 118 wherein the second open end 118 is closed by means of a cap 120. Fluid pressure force Fl from the pump is communicated to the open end 117 of the relief valve 19 through a line 121.

Figure 2:
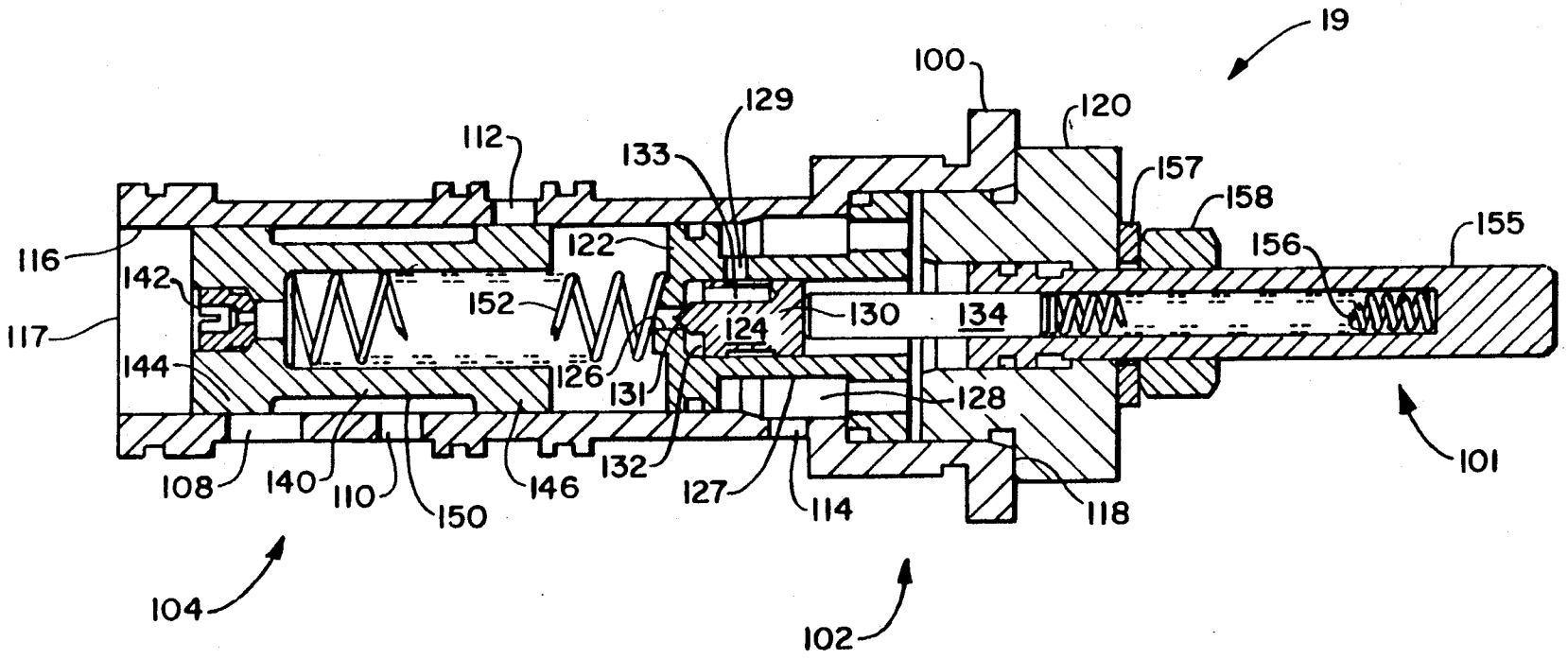
FIG. 2 is a schematic diagram, partly in section, of the relief valve of FIG. 1.

The first stage 102, as shown in FIG. 2, comprises a bushing 122 disposed in the central bore 116, which houses a pilot 124. The bushing 122 has an aperture 126 centrally disposed therein. The bushing 122 also has reduced diameter 127 forming a compartment 128 between the bushing 122 and the housing 100. A port 129 is formed within the bushing 122. The pilot 124 comprises a body 130 and a needle nose 131 forming a shoulder 132 at the junction of the needle nose 131 and the body 130. The pilot also forms a notch 133 within the pilot body 130 and contained by the bushing 122. A push rod 134 rests against the pilot 124 on the opposite side from the needle nose 131.

The second stage 104 comprises a main piston 140 having an orifice 142 formed therein. The main piston 140 further comprises two flanges 144, 146 that fit snugly against the inner wall of the housing 100 and form an elongated notch 150 therebetween. A spring 152 fits inside the main piston 140 and rests against the piston on one side and against the bushing 122 of the first stage on the other side, wherein an additional space between the bushing and the piston is formed.

The adjuster 101 comprises a threaded cylindrical body 155 having a closed end and a spring 156 that rests against the push rod 134 within the cylinder. The adjuster 101 is maintained in place by a lock washer 157 and a nut 158.

When the pump pressure FPF Fl is at or below a preset relief valve pressure, the pilot 124 abuts the bushing in a closed position. In operation, the relief valve 19 is activated if the pump pressure FPF Fl exceeds the preset fluid pressure force limit prescribed in the relief valve by the adjuster 101. The adjuster 101 sets a fluid pressure force limit that the pump fluid pressure force, FPF Fl, should not exceed. The adjustment is facilitated when the cylindrical body 155 of the adjuster 101 is turned so that the installed compression on the spring 156 is changed to a desired value. The greater the force on the spring 156, the greater the preset pressure in the relief valve.

The pump pressure FPF F1 is communicated to the relief valve through the open end 117 of the housing 100 via line 121. The hydraulic fluid then travels through the orifice 142 into the inner portion of the main piston 140 and through the aperture 126 so that it comes into contact with the needle nose 131. The pilot 124 is urged open when the fluid pressure force exceeds the preset fluid pressure force, since the fluid pressure force overcomes the spring compression in the adjuster 101, thus moving the pilot away from the bushing 122. As the pilot retreats inward and opens the aperture 126, the fluid enters through the aperture 126 into the pilot notch 133 wherefrom it enters the compartment 128 through the port 129 and exits the relief valve through the opening 114 into the tank 24 via lines 115 and 32.

As the hydraulic fluid begins to flow through the orifice 142, a pressure drop facilitating the inward movement of the main piston 140 is produced, since the pressure in line 121, to the left of the orifice 142 is higher than the pressure to the right of the orifice 142. As the main piston 140 is displaced inward, the elongated notch 150 formed on each side thereof allows hydraulic fluid to communicate from the solenoid line 54 through line 113 to opening 112 through the elongated notch 150 to opening 110 to lines 111 and 32 to the tank 24. As the fluid is drained from the solenoid to the tank, the check valve 18 closes since the fluid is no longer pressuring the piston head 58 in the cylinder 46 and the frustoconical portion 36 becomes seated onto the circumference 38 thereby closing the check valve 18. The check valve 18 closure ensures that the elevator's car 12 speed does not become excessive and instead stops its movement.

Also, as the main piston 140 moves inward, the hydraulic fluid communicated from the pump through the line 121 is free to exit through the opening 108 into the tank 24 via lines 109 and 32, thus lowering pressure at the pump.

The geometry of the main piston 140 is designed so that the solenoid opening 112 to tank opening 110 communication opens to close the check valve 18 and to stop the elevator car 12 first. Then the pump opening 117 to tank opening 108 communication is opened to achieve the desired pressure drop in the pump pressure FPF Fl, thereby limiting the pressure of the system.

The pilot mechanism also functions as the catalyst to stop faster elevator cab movement. The hydraulic fluid acting on the needle nose 131, as well as on the shoulder area surface 132, effectuates a faster pressure drop and facilitates the elevator car 12 to halt promptly. Due to the additional shoulder surface area 132, the area that the fluid is acting upon is enlarged and therefore the pilot moves backwards at a faster rate. As the pilot 124 moves back faster, the main piston 140 moves back further thus opening up the communication between the solenoid and the tank through the lines 54, 113, the opening 112, the elongated slot 150 and into the tank 24 through the opening 110 and the lines 111, 32 more. Porting of fluid from the solenoid to the tank facilitates the check valve to close and therefore the elevator cab to halt.

Furthermore, the enlarged shoulder area 132 allows the relief valve 19 to remain open after the initial opening of the pilot 124 at a lower pressure than the preset relief valve pressure. This can be achieved since, in general, the pressure acting on a larger area (shoulder area surface 132) can be lower than the pressure acting on a smaller area (needle nose 131) to counterbalance the same steady pressure (preset relief valve pressure in the adjuster 101). Thus, the enlarged shoulder area 132 allows the relief valve to remain open while the pump is operating, thereby keeping the check valve closed and the elevator car halted until the pump is shut down by the computer.

Although the invention has been shown and described with respect to a best mode embodiment thereof, it should be understood by those of ordinary skill in the art that the foregoing and various other changes, admissions and additions and the form and detailed thereof may be made herein without departing from the spirit and scope hereof.

We claim:

1. A hydraulic elevator system comprising:

a cab, a plunger attaching to said cab, a cylinder for translatingly receiving said plunger, a pump means for communicating a variable fluid pressure to said cylinder, a variable speed motor for providing power to said pump, and a valve for communicating said variable fluid pressure between said pump and said cylinder, said valve comprising;

a check valve for preventing a flow of said variable fluid pressure between said cylinder and said pump, a first circuit means for directing said variable fluid pressure force upon said check valve to urge said check valve to open against a cylinder fluid pressure force if said pump fluid pressure force is approximately equal to said cylinder fluid pressure force, and a second circuit means for closing said check valve by diverting said fluid pressure from said first circuit means to drain pressure when said second circuit means senses that said pump fluid pressure exceeds a preset fluid pressure limit prescribed therein, thereby preventing said elevator cab from further movement, and for reducing said fluid pressure force within said hydraulic elevator system when said second circuit means senses that said pump fluid pressure force exceeds a preset fluid pressure limit prescribed therein, thereby preserving the integrity of said hydraulic elevator system.

2. The hydraulic elevator system of claim 1, wherein said second circuit means further comprises:

a sensing means for detecting if said fluid pressure in said hydraulic elevator system exceeds a preset fluid pressure prescribed in said second circuit means, a first porting means for closing said check valve upon said sensing means detecting excessive said preset fluid pressure within said hydraulic elevator system, and a second porting means for reducing said fluid pressure within said hydraulic elevator system upon said sensing means detecting excessive said preset fluid pressure within said hydraulic elevator system.

3. The hydraulic elevator system of claim 2, wherein said sensing means comprises a pilot valve disposed within said relief valve and activated when said fluid pressure force exceeds said preset fluid pressure force.

4. The hydraulic elevator system of claim 3, wherein said pilot valve further comprises:

a needle nose, a body attached to said needle nose forming a shoulder surface area therebetween that is acted upon by said fluid pressure force as said needle nose is displaced inward into an open position, thereby increasing porting of the fluid by providing a larger surface area for the fluid pressure force to act upon and closing said check valve, while said relief valve remains open at a pressure lower than said preset fluid pressure.

5. The hydraulic elevator system of claim 2, wherein said first circuit means further comprises first communication means for porting said fluid pressure force entering said relief valve from said check valve to a drain pressure.

6. The hydraulic elevator system of claim 2, wherein said second circuit means further comprises first communication means for porting said fluid pressure force from said valving system to a drain pressure.

* * * * *